US010137483B2

(12) United States Patent
Mori et al.

(10) Patent No.: US 10,137,483 B2
(45) Date of Patent: Nov. 27, 2018

(54) ULTRASONIC CLEANING METHOD

(71) Applicant: Siltronic AG, Munich (DE)

(72) Inventors: Yoshihiro Mori, Shunan (JP); Teruo Haibara, Hikari (JP); Etsuko Kubo, Hikari (JP); Masashi Uchibe, Hikari (JP)

(73) Assignee: SILTRONIC AG, Munich (DE)

( * ) Notice: Subject to any disclaimer, the term of this patent is extended or adjusted under 35 U.S.C. 154(b) by 68 days.

(21) Appl. No.: 15/137,004

(22) Filed: Apr. 25, 2016

(65) Prior Publication Data

US 2016/0236242 A1 Aug. 18, 2016

Related U.S. Application Data

(62) Division of application No. 13/618,426, filed on Sep. 14, 2012, and a division of application No. 14/930,777, filed on Nov. 3, 2015, now Pat. No. 9,662,687.

(30) Foreign Application Priority Data

Jan. 27, 2012 (JP) ..... 2012-015450

(51) Int. Cl.
*B08B 3/10* (2006.01)
*B08B 3/12* (2006.01)

(52) U.S. Cl.
CPC . *B08B 3/12* (2013.01); *B08B 3/10* (2013.01)

(58) Field of Classification Search
None
See application file for complete search history.

(56) References Cited

U.S. PATENT DOCUMENTS 5,779,812 A 7/1998 Thies et al.
6,138,698 A 10/2000 Tanaka et al.
6,314,974 B1 11/2001 Schuler et al.
(Continued)

FOREIGN PATENT DOCUMENTS

JP H 0924349 A 1/1997
JP H 10172948 A 6/1998
JP 2001046991 A 2/2001
(Continued)

OTHER PUBLICATIONS

English Machine Translation of JP 2002-177906.*
English Machine Translation of JP 2008-043842.*
English Machine Translation of JP H09-024349.*

*Primary Examiner* — Nicole Blan
(74) *Attorney, Agent, or Firm* — Leydig, Voit & Mayer, Ltd.

(57) ABSTRACT

A cleaning method for cleaning an object involves disposing the object in a cleaning liquid held in a cleaning tank; and ultrasonically vibrating the cleaning liquid via an intermediate medium in contact with the cleaning tank, wherein the ultrasonically vibrating includes: ultrasonically vibrating the cleaning liquid with a first difference between respective sonic velocities allowable in the cleaning liquid and the intermediate medium; and ultrasonically vibrating the cleaning liquid with a second difference between the respective sonic velocities allowable in the cleaning liquid and the intermediate medium, wherein the second difference is different from the first difference.

5 Claims, 9 Drawing Sheets

(56) References Cited

U.S. PATENT DOCUMENTS

2005/0061355 A1 3/2005 Berman et al.

FOREIGN PATENT DOCUMENTS

| | | | | |
|---|---|---|---|---|
| JP | 2001057354 | A | | 2/2001 |
| JP | 2002177906 | A | * | 6/2002 |
| JP | 2007044662 | A | | 2/2007 |
| JP | 2008043842 | A | * | 2/2008 |
| JP | 2009231668 | A | | 10/2009 |
| TW | 201123281 | A | | 7/2011 |

* cited by examiner

ULTRASONIC CLEANING METHOD

CROSS-REFERENCE TO RELATED APPLICATIONS

The present application is a division of U.S. application Ser. No. 14/930,777, filed on Nov. 3, 2015, itself a division of U.S. application Ser. No. 13/618,426, filed on Sep. 14, 2012, claiming priority to Japanese Patent Application No. 2012-015450, filed on Jan. 27, 2012, the entire disclosure of each of which is hereby incorporated by reference herein.

FIELD

The present invention relates to a cleaning method, and particularly to an ultrasonic cleaning method.

BACKGROUND

A conventionally known cleaning method and apparatus is used to dip a substrate or a similar object in a cleaning liquid and thus expose it to an ultrasonic wave to clean it. To clean the object's entire surface uniformly, the cleaning method is required to expose the entire surface to the ultrasonic wave. However, the ultrasonic wave is partially interrupted by a structure (e.g., a holding member for holding the object) in a cleaning tank holding the cleaning liquid, and as a result the object has a surface which is not directly exposed to the ultrasonic wave. In order to solve such a problem, various techniques have conventionally been proposed.

For example, Japanese Patent Laying-Open No. 2009-231668 indicates that an ultrasonic refraction member which can be swung is disposed at a bottom of a cleaning tank, and the ultrasonic refraction member is swung to vary a direction in which an ultrasonic wave travels in the cleaning tank. JP2009-231668 indicates that this minimizes a portion of an object to be cleaned that is insufficiently exposed to the ultrasonic wave.

Furthermore, Japanese Patent Laying-Open No. 2001-057354 indicates that a cleaning tank having an ultrasonic oscillation source provided on a bottom surface thereof has a cylindrical rod disposed on the bottom surface thereof to disperse an ultrasonic wave in the cleaning tank. The document indicates that this allows an object, or a substrate, disposed in the cleaning tank to be cleaned substantially uniformly.

However, the apparatus disclosed in JP2009-231668 is required to have a mechanical structure in the cleaning tank to swing the ultrasonic refraction member, and as a result the apparatus is complex and expensive. Furthermore, while the apparatus disclosed in JP2001-057354 allows a substrate to have a surface having a relatively large area exposed to an ultrasonic wave, the apparatus cannot adjust ultrasonic exposure in conformity to a cleaning condition, and it is thus difficult to completely entirely expose the surface to the ultrasonic wave.

SUMMARY

An aspect of the invention provides disposing the object in a first cleaning liquid held in a first cleaning tank; ultrasonically vibrating the first cleaning liquid via a first intermediate medium in contact with the first cleaning tank; disposing the object in a second cleaning liquid held in a second cleaning tank; and ultrasonically vibrating the second cleaning liquid via a second intermediate medium in contact with the second cleaning tank, wherein the first cleaning liquid and the first intermediate medium allow sonic velocities, respectively, having a first difference from each other, wherein the second cleaning liquid and the second intermediate medium allow sonic velocities, respectively, having a second difference from each other, and wherein the first and second differences are different from each other.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
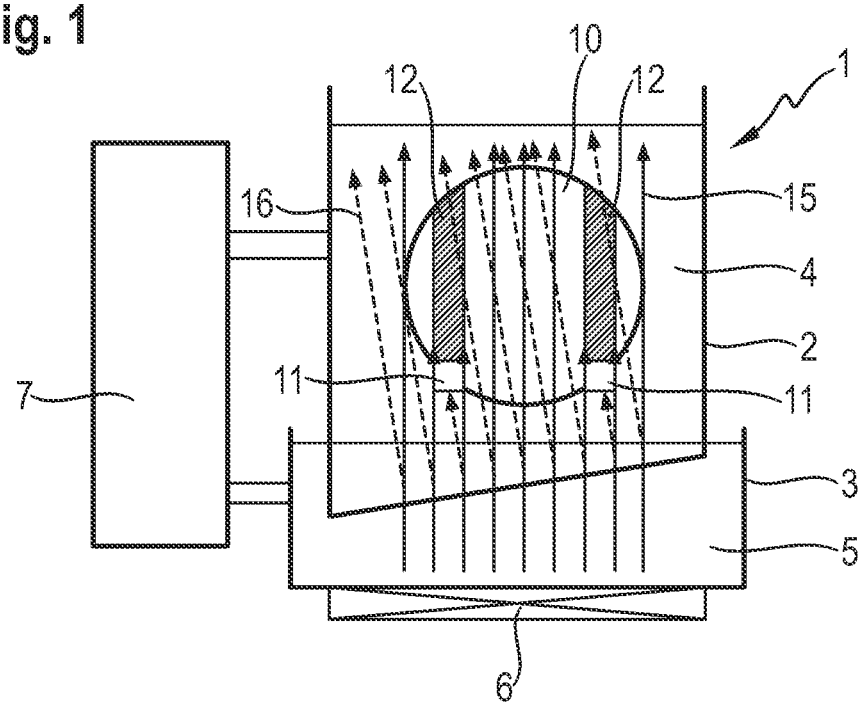
FIG. 1 represents a concept in a schematic diagram of a cleaning apparatus in accordance with the present invention.

An aspect of the invention solves the above described issue and provides a cleaning apparatus, equipment and method that can have a relatively simple configuration to clean an object without an area which is not directly exposed to an ultrasonic wave.

An aspect of the invention provides a cleaning apparatus comprising a cleaning tank, a coupling tank, an ultrasonic wave generation unit, and a modification unit. The cleaning tank holds a cleaning liquid for cleaning an object to be cleaned. The coupling tank holds an intermediate medium and is disposed such that the cleaning tank has a portion in contact with the intermediate medium. The ultrasonic wave generation unit is provided at the coupling tank and ultrasonically vibrates the cleaning liquid via the intermediate medium. The modification unit modifies a difference in sonic velocity between the cleaning liquid and the intermediate medium.

Varying a difference in sonic velocity between the cleaning liquid and the intermediate medium can modify a condition applied to refract an ultrasonic wave at a boundary of the cleaning tank and the coupling tank. This allows the ultrasonic wave to travel through the cleaning tank in a modified direction and can thus reduce an area of the object (e.g., a substrate) held in the cleaning liquid that is shadowed by a holding member or the like holding the object (i.e., an area that is not directly exposed to the ultrasonic wave).

An aspect of the invention provides cleaning equipment equipped with a plurality of cleaning units cleaning an object to be cleaned with a cleaning liquid, and at least one of the plurality of cleaning units is the cleaning apparatus as described above. At least one cleaning unit that has the configuration of the present cleaning apparatus can have a condition (applied to refract an ultrasonic wave at an interface of the cleaning tank and the intermediate medium) set to be different than another cleaning unit. The object cleaned through the cleaning units sequentially can be cleaned without a surface having a large area which is shadowed and thus not directly exposed to an ultrasonic wave.

An aspect of the invention provides a cleaning method comprising the steps of: disposing in a cleaning liquid held in a cleaning tank an object to be cleaned; and ultrasonically vibrating the cleaning liquid via an intermediate medium in contact with the cleaning tank to clean the object, and the step of ultrasonically vibrating includes the steps of: ultrasonically vibrating the cleaning liquid with the cleaning liquid and the intermediate medium allowing sonic velocities, respectively, having a first difference; and ultrasonically vibrating the cleaning liquid with the cleaning liquid and the intermediate medium allowing sonic velocities, respectively, having a second difference different from the first difference. The first and different, second differences can vary for each cleaning step a condition applied to refract an ultrasonic wave at a boundary of the cleaning tank and the intermediate medium. As a result, the object to be cleaned (e.g., a substrate) held in the cleaning liquid does not have a large area shadowed by a holding member or the like (i.e., a large area that is not directly exposed to an ultrasonic wave).

An aspect of the invention provides a cleaning method comprising the steps of: disposing in a first cleaning liquid held in a first cleaning tank an object to be cleaned; ultrasonically vibrating the first cleaning liquid via a first intermediate medium in contact with the first cleaning tank to clean the object; disposing the object in a second cleaning liquid held in a second cleaning tank; and ultrasonically vibrating the second cleaning liquid via a second intermediate medium in contact with the second cleaning tank to clean the object. The first cleaning liquid and the first intermediate medium allow sonic velocities, respectively, having a first difference and the second cleaning liquid and the second intermediate medium allow sonic velocities, respectively, having a second difference, and the first and second differences are different from each other.

A single coupling tank holds an intermediate medium without having the intermediate medium's condition modified as occasion would require. Rather, first and second intermediate media's respective conditions can be fixed, and the object can thus be cleaned continuously. This allows cleaning to be done in a more efficient and hence less costly method.

Aspects of the present invention can thus provide a cleaning apparatus, equipment and method allowing an object to be cleaned without an area which is not directly exposed to an ultrasonic wave.

Hereinafter, the present invention in embodiment will be described with reference to the drawings. In the figures, identical or corresponding components are identically denoted and will not be described repeatedly.

Reference will be made to FIG. 1 to describe the present cleaning apparatus in a basic configuration. As shown in FIG. 1, the present invention provides a cleaning apparatus 1 including a cleaning tank 2, a coupling tank 3, an ultrasonic wave generation unit 6, and a modification unit 7. Cleaning tank 2 holds a cleaning liquid 4 for cleaning a substrate 10 as an object to be cleaned. Coupling tank 3 holds an intermediate medium 5, and cleaning tank 2 has a portion (a bottom and a portion of a side wall) in contact with intermediate medium 5. The bottom of cleaning tank 2 inclines relative to that of coupling tank 3. Ultrasonic wave generation unit 6 is provided at coupling tank 3, and ultrasonically vibrates cleaning liquid 4 via intermediate medium 5. Ultrasonic wave generation unit 6 is connected to a bottom wall of coupling tank 3 and thus fixed thereto. Modification unit 7 modifies a difference in sonic velocity between cleaning liquid 4 and intermediate medium 5. Modification unit 7 may be connected to one or both of coupling tank 3 and cleaning tank 2. While the difference in sonic velocity can be modified in any methods, it can be done so for example by modifying intermediate medium 5 in temperature or modifying cleaning liquid 4 in temperature, or modifying the intermediate medium in composition. Modification unit 7 has a specific configuration, by way of example, as will be described later.

Cleaning apparatus 1 thus structured can modify a difference in sonic velocity between cleaning liquid 4 and intermediate medium 5 to modify a condition applied to refract an ultrasonic wave that is emitted from ultrasonic wave generation unit 6 at a boundary of cleaning tank 2 and coupling tank 3 (more specifically, a boundary portion of cleaning liquid 4 held in cleaning tank 2 and intermediate medium 5 in contact with the bottom of cleaning tank 2). As a result, an ultrasonic wave output from ultrasonic wave generation unit 6 in a direction of an arrow 15 is refracted at the boundary portion so that the ultrasonic wave can be modified in direction from that of arrow 15 to that of an arrow 16 and thus travel through cleaning tank 2 in the latter direction.

If the object to be cleaned, or substrate 10, held in cleaning liquid 4 is exposed to an ultrasonic wave traveling along arrow 15, substrate 10 has an area 12 shadowed by holding member 11 or the like for holding substrate 10 (i.e., a portion which is not directly exposed to the ultrasonic wave). Modifying a condition applied to refract an ultrasonic wave at the boundary portion to modify the ultrasonic wave in direction from arrow 15 to arrow 16 to travel through cleaning liquid 4 in the latter direction can minimize such a shadowed area 12 to a substantially negligible level.

Cleaning apparatus 1 in a specific exemplary configuration will now be described with reference to FIG. 2. The cleaning apparatus 1 shown in FIG. 2 basically has a configuration similar to the FIG. 1 cleaning apparatus 1, except that the former has modification unit 7 shown in FIG. 1 implemented as a heater 17 connected to coupling tank 3 via a pipe 18 as a temperature adjustment unit. Heater 17 is connected to a source of intermediate medium 5 (e.g., a tank having intermediate medium 5 stored therein) via a pipe 19. Intermediate medium 5 is supplied via pipe 19, heater 17, and pipe 18 to coupling tank 3, as indicated by an arrow 13. Heater 17 can heat intermediate medium 5 to raise the temperature of intermediate medium 5 and thus supply it to coupling tank 3. Coupling tank 3 receives intermediate medium 5, which overflows from an upper portion of coupling tank 3 to outside coupling tank 3, as indicated by an arrow 20.

Figure 2:
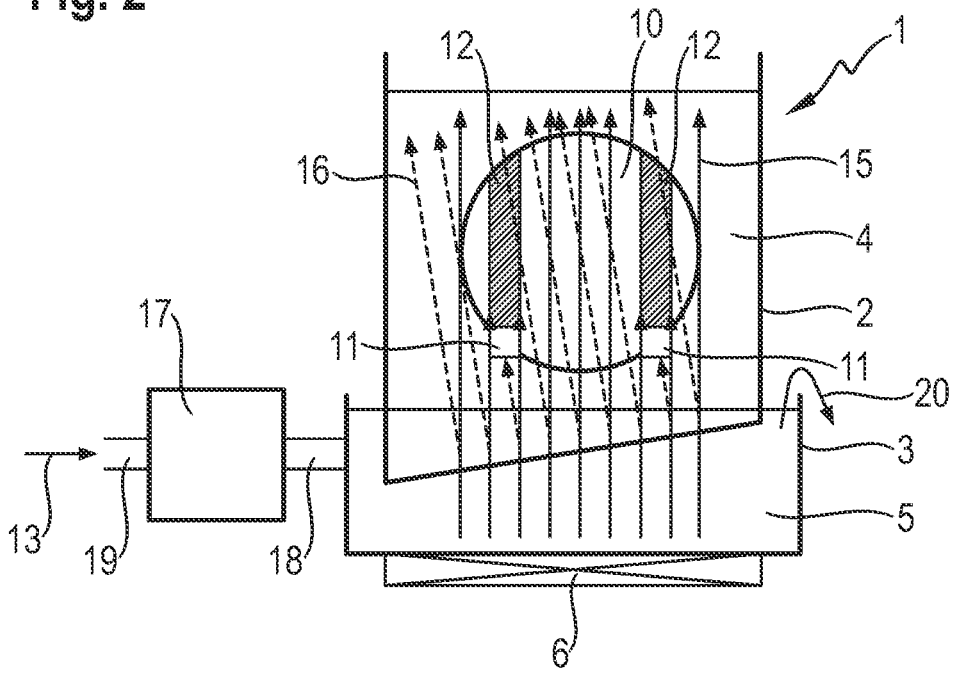
FIG. 2 is a schematic diagram in cross section showing a first embodiment of the cleaning apparatus in accordance with the present invention.

Modification unit 7 (see FIG. 1) that includes heater 17 that is a heating member serving as a temperature adjustment unit to modify intermediate medium 5 in temperature, as indicated in FIG. 2, allows intermediate medium 5 to be adjusted in temperature without modifying intermediate medium 5 in composition or the like. As sonic velocity in intermediate medium 5 varies with the temperature of intermediate medium 5, thus controlling intermediate medium 5 in temperature consequently allows sonic velocity in intermediate medium 5 to be controlled. This allows the apparatus to have a relatively simple configuration to modify a condition applied to refract an ultrasonic wave at the boundary portion of cleaning tank 2 and coupling tank 3. As a result, cleaning apparatus 1 can be manufactured at a reduced cost. Note that intermediate medium 5 may be controlled in temperature by a cooler device rather than heater 17.

Figure 3:
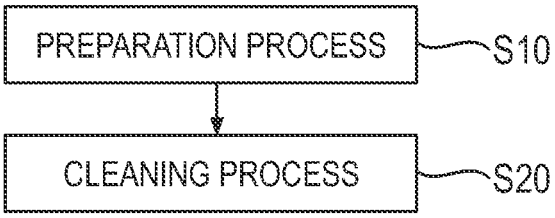
FIG. 3 is a flowchart for illustrating a cleaning method in accordance with the present invention.

Reference will now be made to FIG. 3 to FIG. 6 to describe the present cleaning method using cleaning apparatus 1 shown in FIG. 2. With reference to FIG. 3, the present cleaning method initially provides a preparation process (S10). In this process (S10), cleaning liquid 4 and intermediate medium 5, as predetermined, are introduced into the cleaning apparatus 1 cleaning tank 2, coupling tank 3, and the like. Furthermore, an object to be cleaned, or substrate 10, is also prepared.

Figure 4:
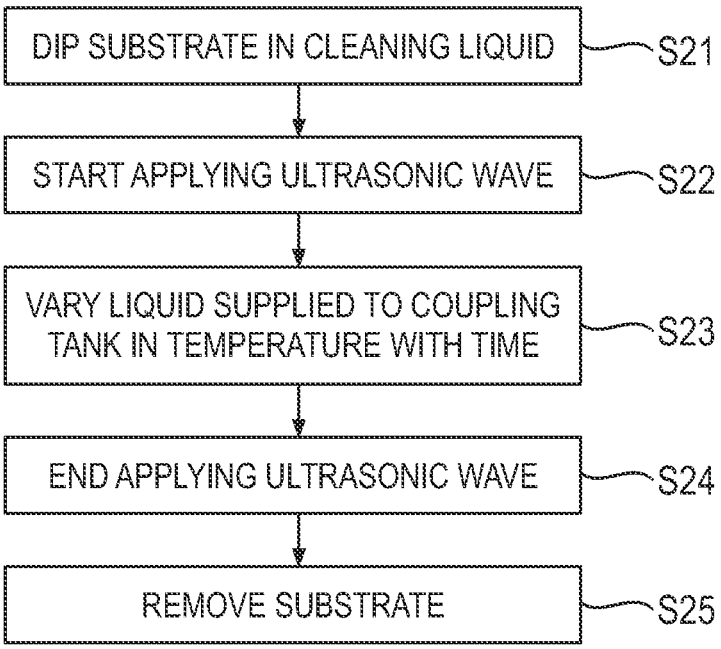
FIG. 4 is a flowchart for illustrating a cleaning process of FIG. 3.

Subsequently, a cleaning process (S20) shown in FIG. 3 is performed. This process (S20) is performed specifically through steps shown in FIG. 4. With reference to FIG. 4, in this process (S20), a step (S21) is performed to dip a substrate in the cleaning liquid as the step of disposing the object in cleaning liquid 4 held in cleaning tank 2. In this step (S21), the object to be cleaned, or substrate 10, is disposed in cleaning liquid 4, as shown in FIG. 2. Substrate 10 is supported by holding member 11 provided in cleaning tank 2.

Subsequently, as shown in FIG. 4, applying an ultrasonic wave is started (step S22). In this step, ultrasonic wave generation unit 6 generates an ultrasonic wave and cleaning liquid 4 is exposed thereto via intermediate medium 5. Such ultrasonic exposure starts cleaning substrate 10.

Figure 5:
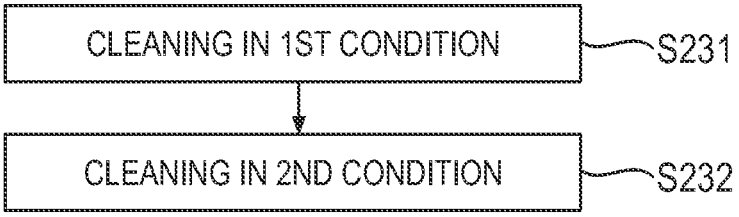
FIG. 5 is a flowchart for illustrating an example of a step S23 of FIG. 4.

Subsequently, a liquid supplied to the coupling tank (or intermediate medium 5) is varied in temperature with time (step S23). More specifically, intermediate medium 5 of a first temperature is supplied to coupling tank 3 to apply a first condition to perform a cleaning step (S231), as indicated in FIG. 5. Intermediate medium 5 may be set at the first temperature by operating heater 17 to heat intermediate medium 5, or without operating heater 17 intermediate medium 5 of an initial temperature may be supplied to coupling tank 3. In cleaning liquid 4 the ultrasonic wave may travel in a direction indicated for example by arrow 15 shown in FIG. 2. Note that ultrasonic wave generation unit 6 can generate an ultrasonic wave for example having a frequency of 1 MHz and a watt density of 2.5 $W/cm^2$.

Subsequently, in step S23, a second condition is applied to perform a cleaning step (step S232), as shown in FIG. 5. In doing so, heater 17 heats intermediate medium 5 to modify intermediate medium 5 in temperature from the first temperature to a different, second temperature. Thus modifying intermediate medium 5 in temperature modifies a condition applied to refract the ultrasonic wave at the bottom of cleaning tank 2, and accordingly, in cleaning liquid 4, the ultrasonic wave travels in a direction different from that in which the ultrasonic wave travels in step S231. For example, in step S232, the ultrasonic wave may travel through cleaning liquid 4 along arrow 16 indicated in FIG. 2.

Heater 17 that modifies the temperature of intermediate medium 5 supplied to coupling tank 3 allows an ultrasonic wave to travel through cleaning liquid 4 in a modified direction, and as a result can reduce area 12 in size that would otherwise be shadowed by holding member 11 and thus not directly be exposed to the ultrasonic wave. Steps S231 and S232 may each be performed for example for a period of 2 minutes. Furthermore, intermediate medium 5 can be water (pure water), and the first temperature can for example be 25 degrees centigrade and the second temperature can for example be 80 degrees centigrade. Note that the first temperature and the second temperature can be set for example at any value within a range from 25 to 80 degrees centigrade.

Subsequently, as shown in FIG. 4, applying the ultrasonic wave ends (step S24). Specifically, in this step (S24), ultrasonic wave generation unit 6 stops generating the ultrasonic wave. The application of (or exposure to) the ultrasonic wave can be ended for example when an ultrasonic wave exposure time has attained a predetermined prescribed period.

Subsequently, the substrate is removed (step S25). In this step, substrate 10 having been cleaned is removed from cleaning tank 2. Substrate 10 can thus be cleaned.

Figure 6:
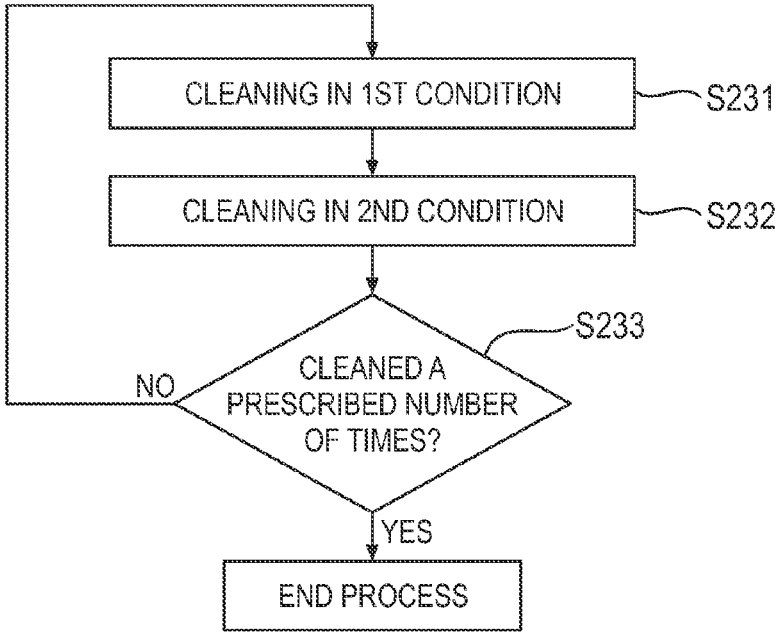
FIG. 6 is a flowchart for illustrating another example of step S23 of FIG. 4.

Note that while the FIG. 4 step S23 may be performed to apply the first condition and the second condition, each only once, in cleaning, as indicated in FIG. 5, the step may alternatively be performed to perform the cleaning step in the first condition (S231) and the cleaning step in the second condition (S232) in turn more than once repeatedly, as indicated in FIG. 6. More specifically, as indicated in FIG. 6, the cleaning step in the first condition (S231) and the cleaning step in the second condition (S232) are performed and thereafter a step (S233) is performed to determine whether steps S231, S232 have been performed a predetermined number of times. If not (No at S233), steps S231, S232 are again performed. Steps S231, S232 may be performed cyclically as prescribed (e.g., each for a period of 2 minutes). If steps S231, S232 have been performed the predetermined number of times (Yes at S233), the FIG. 6 process ends and a subsequent step is performed. The cleaning step in the first condition and the cleaning step in the second condition that are repeated more than once ensure that substrate 10 is better cleaned.

Figure 7:
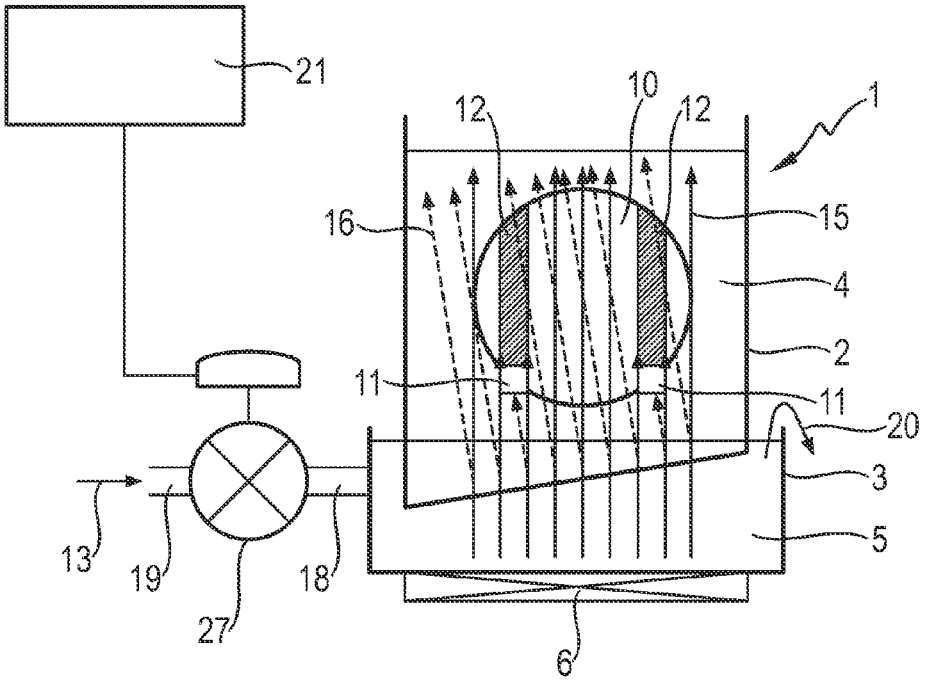
FIG. 7 is a schematic diagram in cross section showing an exemplary variation of the cleaning apparatus shown in FIG. 2.

Reference will now be made to FIG. 7 to describe the FIG. 2 cleaning apparatus 1 in an exemplary variation. The FIG. 7 cleaning apparatus 1 is basically similar in configuration to the FIG. 2 cleaning apparatus 1, except that the former has a portion corresponding to modification unit 7 (see FIG. 1) that is differently configured, i.e., heater 17 is replaced with an automatic valve 27 connected to coupling tank 3 via pipe 18 and capable of varying the flow rate of intermediate medium 5. A control unit 21 is connected to automatic valve 27. Control unit 21 can control the valve position of automatic valve 27. A flow rate adjustment unit, or automatic valve 27, is connected via pipe 19 to a unit supplying degassed water as intermediate medium 5. Note that degassed water is water having a dissolved-gas concentration reduced to 2 ppm or less.

It is known that when degassed water is exposed to an ultrasonic wave, the degassed waters temperature rapidly increases. Automatic valve 27 and control unit 21 that vary an amount of intermediate medium 5 (or degassed water) supplied into coupling tank 3 allow the degassed water to be retained in coupling tank 3 (i.e., exposed to an ultrasonic wave) for a varying period of time and, as a result, controlled in temperature. Intermediate medium 5 or the degassed water varied in temperature allows sonic velocity in intermediate medium 5 to be controlled, similarly as done in the FIG. 2 cleaning apparatus 1. This allows the apparatus to have a relatively simple configuration to modify a condition applied to refract an ultrasonic wave at the boundary portion of cleaning tank 2 and coupling tank 3.

When the FIG. 7 cleaning apparatus 1 is used to perform a cleaning method, the cleaning method is basically similar to the FIGS. 3-6 cleaning method. Note that, in the FIG. 4 step S23, intermediate medium 5 is varied in temperature with time via automatic valve 27 of FIG. 7 so that intermediate medium 5, e.g. degassed water, has a varied flow rate. For example, the cleaning step in the first condition (S231) is performed with automatic valve 27 controlled to allow the degassed water to be introduced into coupling tank 3 continuously for one minute in an amount of 5 liters/min. In contrast, the cleaning step in the second condition (S232) is performed with automatic valve 27 controlled to zero the amount of the degassed water introduced into coupling tank 3. This allows the degassed water exposed to an ultrasonic wave to be heated to a maximum of approximately 80 degrees centigrade. This can be as effective as the FIGS. 3-6 cleaning method.

Figure 8:
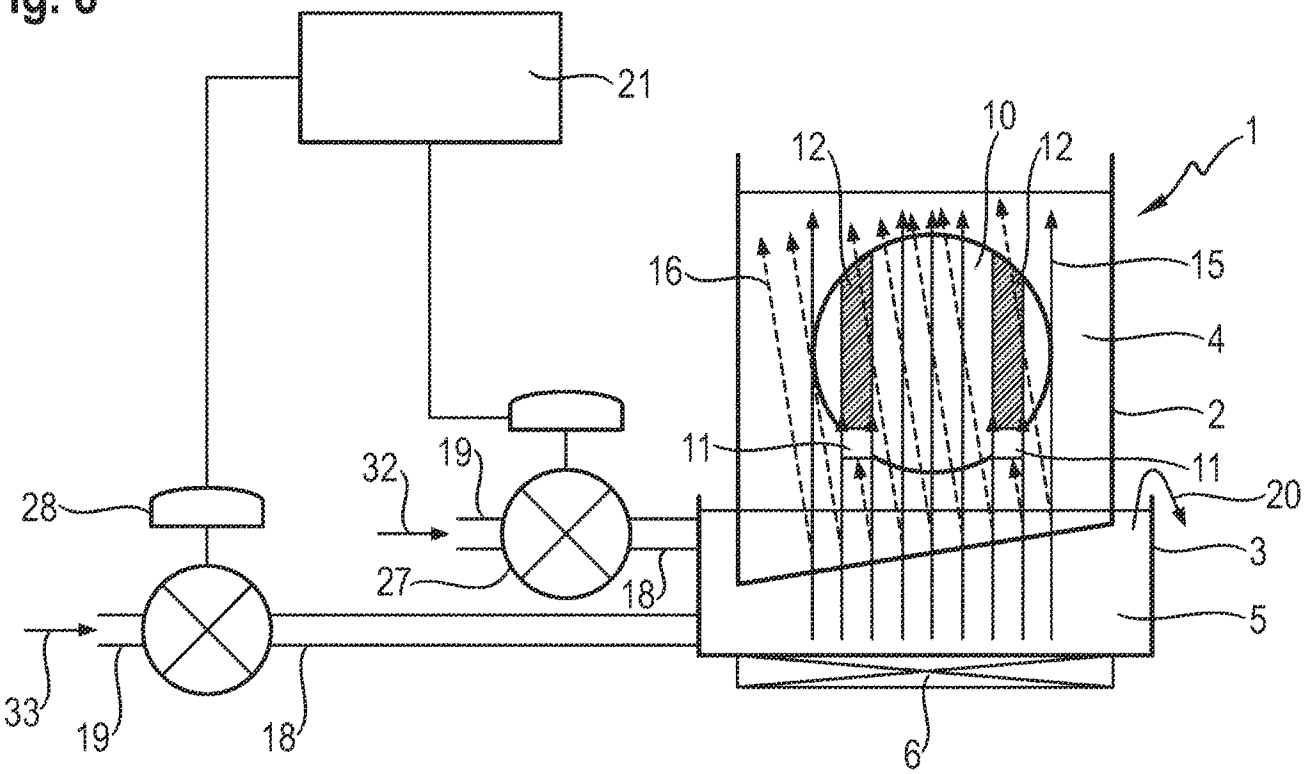
FIG. 8 is a schematic diagram in cross section showing a second embodiment of the cleaning apparatus in accordance with the present invention.

With reference to FIG. 8, the present invention provides cleaning apparatus 1 in a second embodiment, as will be described hereinafter. The FIG. 8 cleaning apparatus 1 basically has a configuration similar to the FIG. 2 cleaning apparatus 1, except that the former has a portion corresponding to modification unit 7 (see FIG. 1) that is differently configured. Specifically, the FIG. 8 cleaning apparatus 1 is provided with pipes of two systems, respectively, to supply coupling tank 3 with an intermediate medium. In one system, pipe 18 connected to coupling tank 3 is connected to automatic valve 27 which is connected via pipe 19 to a water supply source (a water tank for example). Automatic valve 27 is supplied with water through pipe 19, as indicated by an arrow 32. Furthermore, in the other system, pipe 18 connected to coupling tank 3 has an automatic valve 28 connected thereto. Furthermore, automatic valve 28 is connected to an ethanol supply source (an ethanol tank for example) via pipe 19. Automatic valve 28 is supplied with ethanol through pipe 19, as indicated by an arrow 33.

Automatic valves 27 and 28 are electrically connected to control unit 21 and operable in response to a control signal issued from control unit 21 to adjust their valve positions. The systems that allow water and ethanol, respectively, to be supplied to coupling tank 3 at predetermined flow rates, respectively, allow coupling tank 3 to hold intermediate medium 5 having a composition (more specifically, a water/ethanol ratio) adjusted as desired. Intermediate medium 5 thus modified in composition allows sonic velocity therein to be varied. As a result an effect similar to that of the FIG. 2 cleaning apparatus 1 can be obtained. For example, automatic valves 27 and 28 may be controlled to allow the cleaning step in the first condition (S231) to be performed with water alone supplied to coupling tank 3 and the cleaning step in the second condition (S232) to be performed with ethanol alone supplied to coupling tank 3. Steps S231, S232 may be performed cyclically as prescribed (e.g., each for a period of 2 minutes). This allows coupling tank 3 to hold intermediate medium 5 having a continuously and cyclically varying composition.

Note that while herein the systems feed media of water and ethanol by way of example, the systems may feed any media that allow different sonic velocities, respectively, (e.g., that are different in composition).

Figure 9:
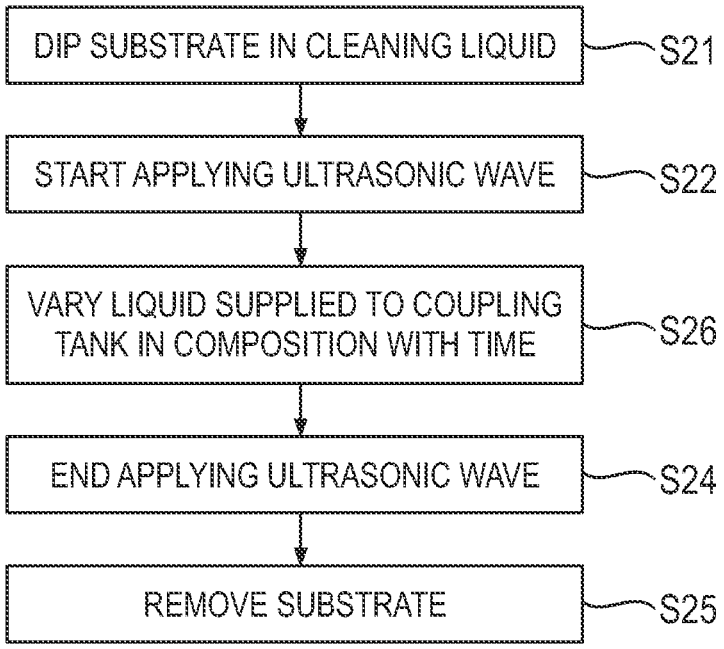
FIG. 9 is a flowchart for illustrating a cleaning process using the cleaning apparatus shown in FIG. 8.

Reference will now be made to FIG. 9 to describe a cleaning method using the FIG. 8 cleaning apparatus. The cleaning method using the FIG. 8 cleaning apparatus 1 is basically similar to the FIGS. 3-6 cleaning method. However, the former differs from the latter in that for the FIG. 3 cleaning process S20, a process shown in FIG. 9, rather than the FIG. 4 process, is performed. Herein, the FIG. 9 process is basically similar to the FIG. 4 process. That is, as well as the FIG. 4 process, the FIG. 9 process includes the step of dipping a substrate in a cleaning liquid (S21) and the step of starting applying an ultrasonic wave (S22). Then, the FIG. 4 step S23 is replaced in the FIG. 9 process with the step of varying a liquid supplied to the coupling tank (or intermediate medium 5) in composition with time (S26).

More specifically, intermediate medium 5 of a first composition is supplied to coupling tank 3 to apply a first condition to perform a cleaning step (S231), as indicated in FIG. 5. To allow intermediate medium 5 to have the first composition, automatic valves 27 and 28 are controlled by control unit 21 to have prescribed valve positions, respectively, to provide intermediate medium 5 of water and ethanol at a first ratio. At the time, cleaning liquid 4 may pass an ultrasonic wave in a direction indicated for example by arrow 15 shown in FIG. 2.

Subsequently, in step S26, a second condition is applied to perform a cleaning step (S232), as indicated in FIG. 5. At the time, automatic valves 27 and 28 have their valve travels adjusted to be different from those in the cleaning step in the first condition (S231), i.e., so that the intermediate medium 5 water/ethanol ratio in coupling tank 3 is changed and thus adjusted from the first ratio to a different, second ratio. This varies intermediate medium 5 in composition from the first composition to a different, second composition. Thus modifying intermediate medium 5 in composition modifies a condition applied to refract an ultrasonic wave at the bottom of cleaning tank 2, and accordingly, cleaning liquid 4 allows the ultrasonic wave to travel therethrough in a direction different from that in which the ultrasonic wave travels in step S231. For example, in step S232, the ultrasonic wave may travel through cleaning liquid 4 along arrow 16 indicated in FIG. 2.

Control unit 21 and automatic valves 27 and 28 that operate to modify the composition of intermediate medium 5 supplied to coupling tank 3 allow an ultrasonic wave to travel through cleaning liquid 4 in a modified direction, and as a result can reduce area 12 in size that would otherwise be shadowed by holding member 11 and thus not directly be exposed to the ultrasonic wave.

Subsequently, as done in the FIG. 4 process, applying the ultrasonic wave ends (step S24) and the substrate is removed (step S25). The FIG. 8 cleaning apparatus 1 can thus be used to clean substrate 10.

Figure 10:
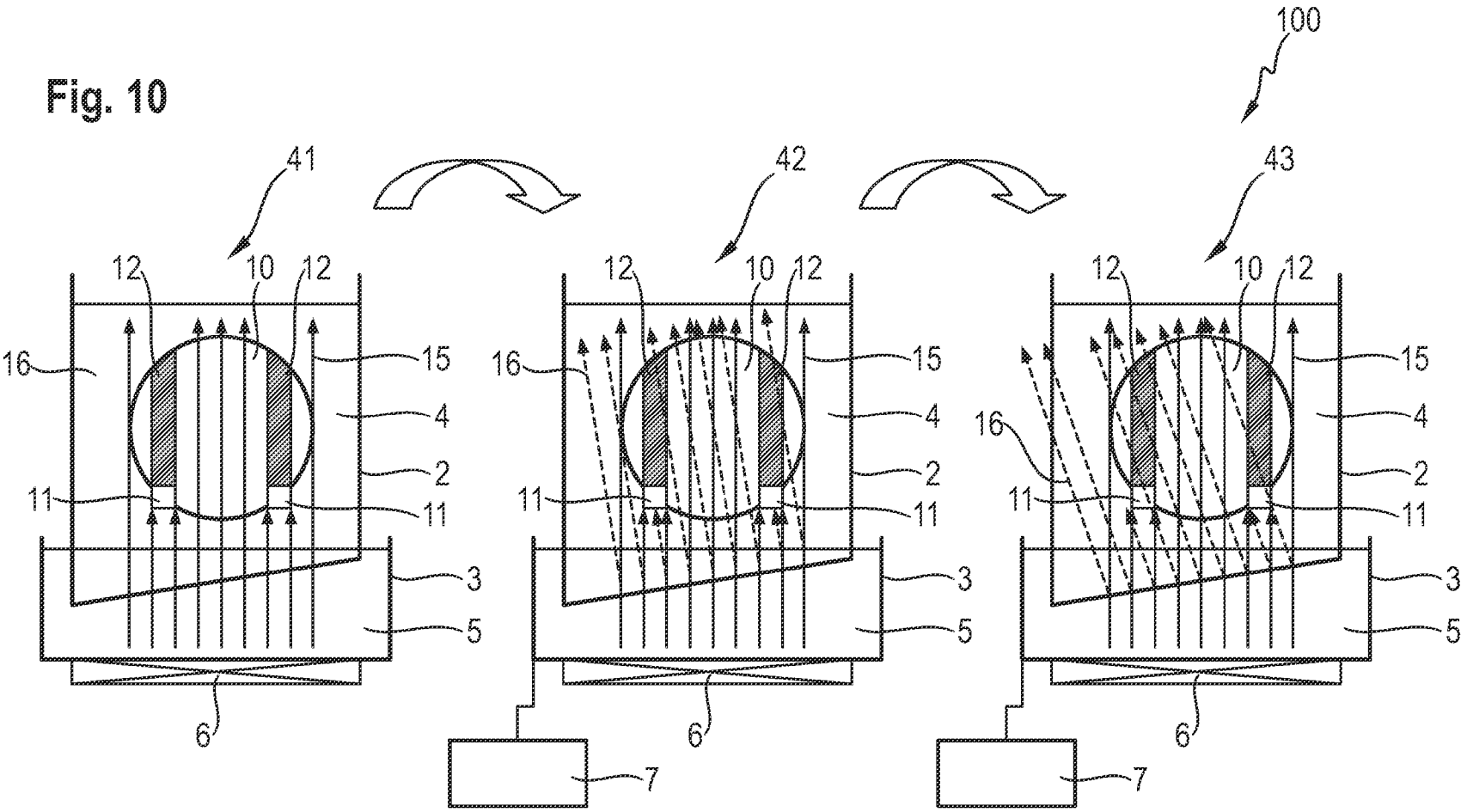
FIG. 10 is a schematic diagram in cross section showing cleaning equipment in accordance with the present invention.

With reference to FIG. 10, the present invention in a third embodiment provides cleaning equipment 100, as will be described hereinafter. As shown in FIG. 10, cleaning equipment 100 comprises three cleaning units 41-43 and a substrate transfer member (not shown). Cleaning units 42 and 43 are basically similar in configuration to the FIG. 1 cleaning apparatus 1, and include modification unit 7 connected to coupling tank 3. Modification unit 7 can have a configuration corresponding to the modification unit of cleaning apparatus 1 shown in FIG. 2, FIG. 7, and FIG. 8. Cleaning unit 41 also has a configuration basically similar to the FIG. 1 cleaning apparatus 1, except that the former does not include modification unit 7. Accordingly in cleaning unit 41 an ultrasonic wave travels through cleaning tank 2 in a direction fixed as indicated by an arrow 15.

In contrast, cleaning units 42 and 43 are provided with modification unit 7, and thus allow an ultrasonic wave to be modified in direction from that of arrow 15 to that of arrow 16 and thus travel through cleaning tank 2 in the latter direction. Furthermore, the FIG. 10 cleaning equipment 100 allows cleaning units 42 and 43 to each have a different difference in sonic velocity between cleaning liquid 4 and intermediate medium 5, as varied by modification unit 7. This allows cleaning units 42 and 43 to provide ultrasonic waves refracted at the bottom of cleaning tank 2 to different extents, respectively, and thus traveling through cleaning tank 2 in directions (along allow 16), respectively, that are different from each other. As a result, substrate 10 cleaned by a plurality of cleaning units 41, 42, 43 sequentially can substantially be free of area 12 that is shadowed by holding member 11 and thus not directly exposed to an ultrasonic wave. Furthermore, cleaning units 42 and 43 can each have a different difference in sonic velocity between cleaning liquid 4 and intermediate medium 5 at a determined value, as set by modification unit 7, and cleaning units 42 and 43 thus no longer require an operation to change a difference in sonic velocity as described above, as occasion requires, and substrate 10 can thus be cleaned rapidly. For example, the cleaning units 41, 42, 43 cleaning liquid 4 and the cleaning unit 41 intermediate medium 5 may all be water (pure water) of 25 degrees centigrade, and the cleaning unit 42 intermediate medium 5 may be water of 50 degrees centigrade and the cleaning unit 43 intermediate medium 5 may be water of 80 degrees centigrade. Alternatively, the cleaning units 41, 42, 43 cleaning liquid 4 and the cleaning unit 41 intermediate medium 5 may all be water (pure water) of 25 degrees centigrade, and the cleaning unit 42 intermediate medium 5 may be an aqueous solution with ethanol having a proportion of 50% by volume and the cleaning unit 43 intermediate medium 5 may be ethanol liquid (with ethanol having a proportion of 100%).

Figure 11:
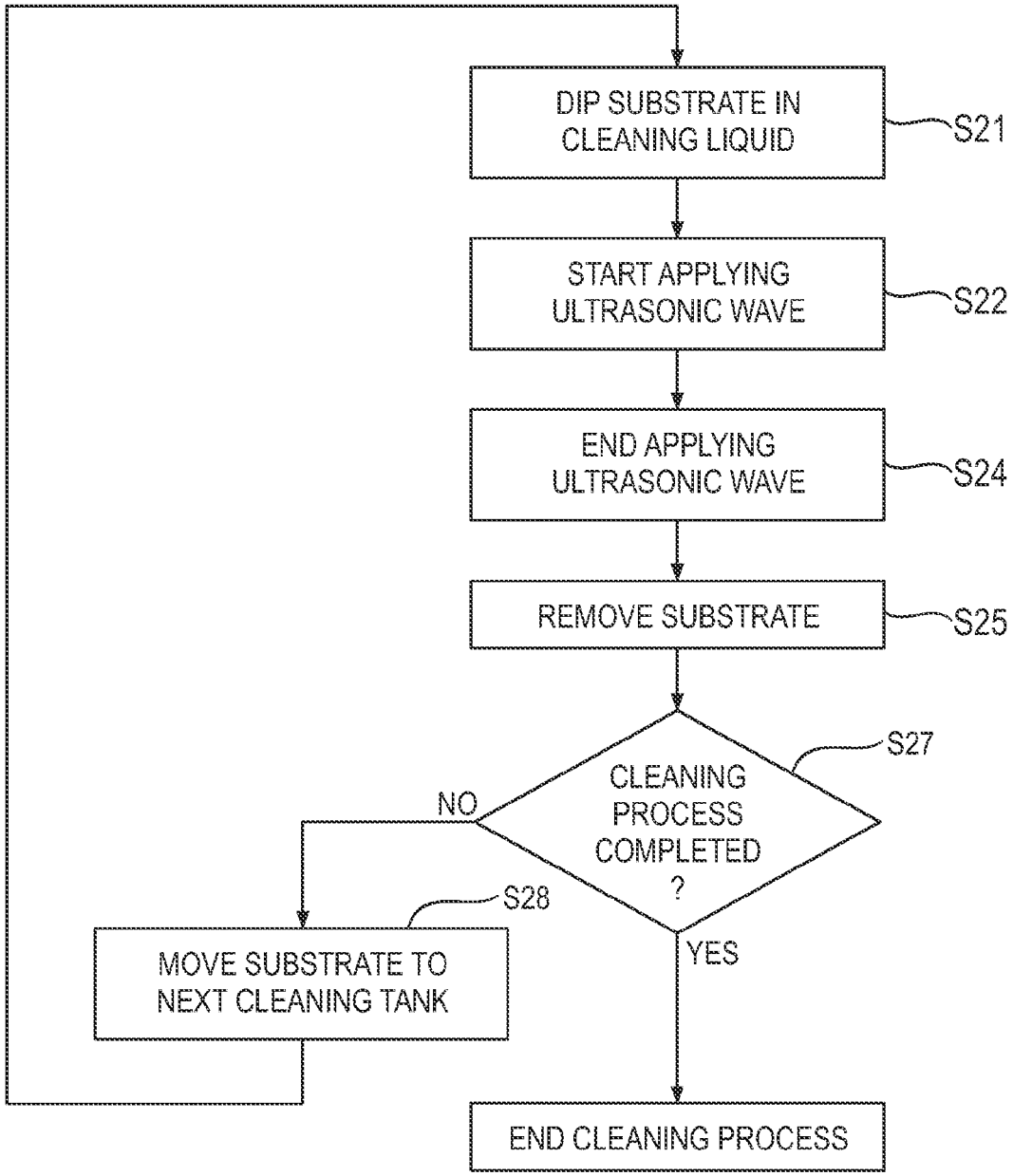
FIG. 11 is a flowchart for illustrating a cleaning process employing the cleaning equipment shown in FIG. 10.

Reference will now be made to FIG. 11 to describe a cleaning method using the FIG. 10 cleaning equipment 100. As shown in FIG. 11, the cleaning method using the FIG. 10 cleaning equipment 100 is basically similar to the FIG. 3 cleaning method, except that the FIG. 3 cleaning process S20 is specifically different from the FIG. 4 process. That is, the cleaning method using the FIG. 10 cleaning equipment 100 is done as follows: substrate 10 is disposed initially in cleaning unit 41, then in cleaning unit 42, and then in cleaning unit 43 sequentially at each cleaning tank 2, and thus cleaned in each cleaning unit 41, 42, 43 sequentially.

That is, the FIG. 11 step S21 of dipping a substrate in a cleaning tank is performed by initially disposing substrate 10 in the cleaning unit 41 cleaning tank 2. Subsequently, as shown in FIG. 11, applying an ultrasonic wave is started (step S22). In this step S22, intermediate medium 5 is supplied to coupling tank 3 of cleaning unit 41, while ultrasonic wave generation unit 6 generates an ultrasonic wave. As a result, the cleaning tank 2 cleaning liquid 4 receives the ultrasonic wave, and cleaning unit 41 ultrasonically cleans substrate 10. Note that cleaning unit 41 is not provided with modification unit 7, and accordingly, the ultrasonic wave travels through cleaning tank 2 along arrow 15. Accordingly, as shown in FIG. 10, cleaning unit 41 performs cleaning with holding member 11 causing shadowed area 12.

Cleaning unit 41 provides cleaning continuously for a predetermined period of time, and thereafter, applying the ultrasonic wave ends (step S24) as shown in FIG. 11. Step S24 is similar to that of the FIG. 4 process. Then, the substrate is removed (step S25). In step S25, the substrate transfer member (not shown) removes substrate 10 from cleaning tank 2 of cleaning unit 41.

Then, as shown in FIG. 11, it is determined whether the cleaning process is completed (step S27). In step S27, it is determined whether cleaning units 41, 42, 43 have all cleaned substrate 10. This may be determined for example by using a position sensor to detect whether the substrate transfer member (or substrate 10) is located over cleaning unit 43 that performs final cleaning (i.e., whether substrate 10 has been removed from the last cleaning unit 43).

If in step S27 it is determined that the cleaning process is not completed (NO), the substrate is moved to over the next cleaning tank (step S28). Specifically, the substrate transfer member moves substrate 10 to over cleaning tank 2 of the next cleaning unit (cleaning unit 42 for example). Then, steps S21-S25 are performed in the next cleaning unit. After the cleaning units have all cleaned substrate 10 in this way, it is determined in step S27 that the cleaning process has been completed (YES). The cleaning process is thus completed.

As set forth above, cleaning units 41, 42, 43 each have a different condition applied to refract an ultrasonic wave at the bottom of cleaning tank 2 and thus cause the ultrasonic wave to travel through cleaning tank 2 in a different direction. As a result, substrate 10 cleaned by cleaning units 41, 42, 43 sequentially can have its surface cleaned substantially without an area that is not directly exposed to the ultrasonic wave (or shadowed area 12).

Hereinafter, the present invention's characteristic configurations will be enumerated, although some of them overlap the above described embodiments.

The present invention provides cleaning apparatus 1 including cleaning tank 2, coupling tank 3, ultrasonic wave generation unit 6, and modification unit 7, as shown in FIG. 1. Cleaning tank 2 holds cleaning liquid 4 for cleaning substrate 10 serving as an object to be cleaned. Coupling tank 3 holds intermediate medium 5 and cleaning tank 2 has a portion in contact with intermediate medium 5. Ultrasonic wave generation unit 6 is provided at coupling tank 3, and ultrasonically vibrates cleaning liquid 4 via intermediate medium 5. Modification unit 7 modifies a difference in sonic velocity between cleaning liquid 4 and intermediate medium 5.

This can modify a condition applied to refract an ultrasonic wave at a boundary of cleaning tank 2 and coupling tank 3. This allows the ultrasonic wave to travel through cleaning tank 2 in a modified direction and can thus reduce area 12 of the object (or substrate 10) held in cleaning liquid 4 that is shadowed by holding member 11 holding the object (i.e., an area that is not directly exposed to the ultrasonic wave).

In cleaning apparatus 1, modification unit 7 may include a temperature adjustment unit to vary intermediate medium 5 in temperature, as shown in FIG. 2 (e.g., heater 17 of FIG. 2 or automatic valve 27 of FIG. 7). Adjusting intermediate medium 5 in temperature allows sonic velocity in intermediate medium 5 to be controlled without modifying intermediate medium 5 in composition or the like, and the apparatus can have a relatively simple configuration to modify a condition applied to refract an ultrasonic wave at a boundary portion of cleaning tank 2 and coupling tank 3. As a result, cleaning apparatus 1 can be manufactured at a reduced cost.

In cleaning apparatus 1, the temperature adjustment unit may have heater 17 as a heating member to heat intermediate medium 5. Heater 17 that can adjust intermediate medium 5 in temperature allows sonic velocity in intermediate medium 5 to be controlled without modifying intermediate medium 5 in composition or the like. This allows the apparatus to have a relatively simple configuration to modify a condition applied to refract an ultrasonic wave at a boundary portion of cleaning tank 2 and coupling tank 3. As a result, cleaning apparatus 1 can be manufactured at a reduced cost.

In cleaning apparatus 1, as shown in FIG. 7, intermediate medium 5 may be degassed water and the temperature adjustment unit may have a flow rate adjustment unit (or automatic valve 27) to adjust the amount of the degassed water supplied to coupling tank 3. When the degassed water is exposed to an ultrasonic wave, its temperature increases, and intermediate medium 5 can thus be adjusted in temperature without having its composition varied. Controlling intermediate medium 5 in temperature allows sonic velocity in intermediate medium 5 to be controlled, and the apparatus can have a relatively simple configuration to modify a condition applied to refract an ultrasonic wave at a boundary portion of cleaning tank 2 and coupling tank 3. As a result, cleaning apparatus 1 can be manufactured at a reduced cost.

In cleaning apparatus 1, modification unit 7 may include a composition adjustment unit to modify intermediate medium 5 in composition, as shown in FIG. 8 (e.g., automatic valves 27 and 28 shown in FIG. 8). In this case, while cleaning tank 2 and coupling tank 3 can have an internal configuration as conventional, intermediate medium 5 can be modified in composition (e.g., a liquid introduced into coupling tank 3 as intermediate medium 5 can be modified in composition to have a modified mixture ratio or the like) to control sonic velocity therein and the apparatus can dispense with a device such as a heating member such as heater 17 as shown in FIG. 2. Accordingly, cleaning tank 2 or coupling tank 3 is per se not complicated in configuration and cleaning apparatus 1 can be manufactured accordingly less expensively.

The present invention provides cleaning equipment 100 equipped with a plurality of cleaning units 41, 42, 43 to clean substrate 10 as an object to be cleaned with cleaning liquid 4, and cleaning unit 41, 42, 43 is cleaning apparatus 1 as described above. Single cleaning units 41, 42, 43 have intermediate medium 5 without having a condition varied as occasion requires. Rather, cleaning units 41, 42, 43 can each have its cleaning condition set and fixed differently. Then, substrate 10 can be cleaned for example initially in cleaning unit 41, then in cleaning unit 42, and then in cleaning unit 43 sequentially, and thus continuously cleaned. This allows more efficient cleaning and hence a less costly cleaning process. Furthermore, cleaning units 41, 42, and 43 all having a configuration of cleaning apparatus 1 of the present invention (or modification unit 7) allow a cleaning condition to be set in detail and cleaning to be done further more efficiently.

The present invention provides cleaning equipment 100 equipped with a plurality of cleaning units 41, 42, 43 to clean substrate 10 as an object to be cleaned with cleaning liquid 4, as shown in FIG. 10, and at least one of the plurality of cleaning units 41, 42, 43 (in FIG. 10, two cleaning units 42 and 43) is cleaning apparatus 1 as described above. At least one cleaning unit 42, 43 that has the configuration of cleaning apparatus 1 of the present invention, can have a condition (applied to refract an ultrasonic wave at an interface of cleaning tank 2 and intermediate medium 5) set to be different than another cleaning unit 41. This allows cleaning units 41, 42, 43 to clean substrate 10 sequentially without a surface having area 12 of a large area which is shadowed and thus not directly exposed to an ultrasonic wave.

The present invention provides a cleaning method including, as shown in FIG. 4, the steps of: disposing substrate 10 as an object to be cleaned in cleaning liquid 4 held in cleaning tank 2 (see FIG. 1) (the FIG. 4 S21); and ultrasonically vibrating cleaning liquid 4 via intermediate medium 5 (see FIG. 1) in contact with cleaning tank 2 to clean the object (or substrate 10) (the FIG. 4 steps S22-S24). The step of ultrasonically vibrating includes the steps of: ultrasonically vibrating the cleaning liquid with cleaning liquid 4 and intermediate medium 5 allowing sonic velocities, respectively, having a first difference (the FIG. 5 or 6 step S231); and ultrasonically vibrating cleaning liquid 4 with cleaning liquid 4 and intermediate medium 5 allowing sonic velocities, respectively, having a second difference different from the first difference (the FIG. 5 or 6 step S232). The first and different, second differences can vary for each cleaning step a condition applied to refract an ultrasonic wave at a boundary of cleaning tank 2 and intermediate medium 5. As a result, the object to be cleaned (e.g., substrate 10) held in cleaning liquid 4 does not have shadowed area 12 having an otherwise large area attributed to holding member 11 (i.e., an area which is not directly exposed to an ultrasonic wave).

In the step of ultrasonically vibrating, intermediate medium 5 may be modified in temperature to change the first difference to the second difference in sonic velocity between cleaning liquid 4 and intermediate medium 5, as has been described for the FIG. 4 step S23. Adjusting intermediate medium 5 in temperature allows sonic velocity in intermediate medium 5 to be controlled without modifying intermediate medium 5 in composition or the like. This allows the cleaning method to be performed with cleaning apparatus 1 simply configured and hence less costly including a reduced cleaning cost. Note that cleaning liquid 4 may be modified in temperature to change the first difference to the second difference.

In the step of ultrasonically vibrating, a heating member, or heater 17 (see FIG. 2), may be used to modify intermediate medium 5 in temperature to change the first difference to the second difference. Adjusting intermediate medium 5 in temperature allows sonic velocity to be controlled without modifying intermediate medium 5 in composition or the like. This allows the cleaning method to be performed with cleaning apparatus 1 simply configured and hence less costly including a reduced cleaning cost.

In the above cleaning method, as has been described with reference to FIG. 7, intermediate medium 5 may be degassed water, and in the step of ultrasonically vibrating, a retention time of the degassed water (intermediate medium 5) in contact with cleaning tank 2 may be varied to modify the degassed water in temperature to change the first difference to the second difference in sonic velocity between cleaning liquid 4 and intermediate medium 5. As degassed water exposed to an ultrasonic wave has an increased temperature, simply controlling the flow rate of intermediate medium 5 (or degassed water) allows intermediate medium 5 to be controlled in temperature without modifying intermediate medium 5 in composition. This can in turn control sonic velocity in intermediate medium 5, and the present cleaning method can be performed without substantially modifying the configuration of cleaning apparatus 1 as conventional. This can prevent the cleaning method's cost from increasing.

In the step of ultrasonically vibrating, intermediate medium 5 may be modified in composition to change the first difference to the second difference in sonic velocity between cleaning liquid 4 and intermediate medium 5, as done when the FIG. 8 cleaning apparatus 1 is used. In this case, while cleaning apparatus 1 can be configured of cleaning tank 2, coupling tank 3 and the like having an internal configuration as conventional, intermediate medium 5 conveyed can be modified in composition (i.e., a liquid introduced as intermediate medium 5 can be modified in composition or to have a modified mixture ratio or the like) to control sonic velocity therein, and the FIG. 2 heater 17 or a similar heating member can be dispensed with. Cleaning tank 2, coupling tank 3 and the like per se are thus not complicated in configuration.

The step of ultrasonically vibrating may further include one or more steps of ultrasonically vibrating cleaning liquid 4 with cleaning liquid 4 and intermediate medium 5 allowing sonic velocities, respectively, having a difference different from the first and second differences, as done when the FIG. 10 cleaning equipment 100 is used. In this case, setting three or more conditions applied to refract an ultrasonic wave at a contact interface of cleaning tank 2 and intermediate medium 5 can more effectively reduce an area of an object to be cleaned, or substrate 10, that is not directly exposed to the ultrasonic wave (i.e., shadowed area 12). This ensures that substrate 10 is cleaned.

The present invention provides a cleaning method including the steps of: disposing an object to be cleaned (substrate 10) in a first cleaning liquid 4 held in a first cleaning tank (e.g., cleaning tank 2 of cleaning unit 42 of FIG. 10) (the FIG. 11 step S21); ultrasonically vibrating the first cleaning liquid via a first intermediate medium in contact with the first cleaning tank (intermediate medium 5 of cleaning unit 42 of FIG. 10) to clean the object (the FIG. 11 steps S22-S24); disposing the object (substrate 10) in a second cleaning liquid 4 held in a second cleaning tank (e.g., cleaning tank 2 of cleaning unit 43 of FIG. 10) (the FIG. 11 step S21 performed after the FIG. 11 step S28); and ultrasonically vibrating the second cleaning liquid via a second intermediate medium in contact with the second cleaning tank (intermediate medium 5 of cleaning unit 43 of FIG. 10) to clean the object (the FIG. 11 steps S22-S24). A first difference in sonic velocity between the first cleaning liquid and the first intermediate medium (e.g., a condition applied to cleaning unit 42 to refract an ultrasonic wave) and a second difference in sonic velocity between the second cleaning liquid and the second intermediate medium (e.g., a condition applied to cleaning unit 43 to refract an ultrasonic wave), are different from each other.

In contrast to the FIG. 2 cleaning apparatus 1, a single coupling tank 3 holds intermediate medium 5 without having the intermediate medium's condition modified as occasion would require. Rather, first and second intermediate media's respective conditions can be fixed, and substrate 10 can thus be cleaned continuously. This allows substrate 10 to be cleaned in a more efficient and hence less costly method.

If the above cleaning method is performed with the FIG. 10 cleaning equipment 100 having cleaning units 42 and 43 implemented by the FIG. 2 or FIG. 7 cleaning apparatus 1, at least one of the first intermediate medium (e.g., intermediate medium 5 of cleaning unit 42) and the second intermediate medium (e.g., intermediate medium 5 of cleaning unit 43) may be adjusted in temperature to set the first difference and the second difference differently. Varying the first or second intermediate medium in temperature can in turn vary sonic velocity in the intermediate medium and hence an angle of refraction of an ultrasonic wave at a contact interface of cleaning tank 2 and intermediate medium 5 (i.e., at a bottom surface of cleaning tank 2). This allows sonic velocity in intermediate medium 5 to be modified without modifying intermediate medium 5 in composition or the like. The cleaning method can thus be performed with cleaning equipment 100 relatively simply configured and hence less costly including a reduced cleaning cost.

If the above cleaning method is performed with the FIG. 10 cleaning equipment 100 such that one of cleaning units 42 and 43 is implemented by the FIG. 2 cleaning apparatus 1, at least one of the first intermediate medium and the second intermediate medium may be adjusted in temperature by modification unit 7 including a heating member (heater 17). Adjusting intermediate medium 5 in temperature allows sonic velocity in intermediate medium 5 to be controlled without modifying intermediate medium 5 in composition or the like, and the cleaning method can be performed with cleaning equipment 100 relatively simply configured and hence less costly including a reduced cleaning cost.

If the above cleaning method is performed with the FIG. 10 cleaning equipment 100 having cleaning unit 42 implemented by the FIG. 7 cleaning apparatus 1, the first intermediate medium (intermediate medium 5 of cleaning unit 42) may be degassed water, and a retention time of first intermediate medium 5 in contact with first cleaning tank 2 may be modified to set the temperature of first intermediate medium 5 to be different from that of the second intermediate medium (intermediate medium 5 of cleaning unit 43). As degassed water exposed to an ultrasonic wave has an increased temperature, simply controlling the flow rate of intermediate medium 5 allows intermediate medium 5 to be controlled in temperature without modifying intermediate medium 5 in composition. This can in turn control sonic velocity in intermediate medium 5, and the present cleaning method can be performed without substantially modifying the configuration of cleaning equipment 100 as conventional. This can prevent the cleaning method's cost from increasing.

If the above cleaning method is performed with the FIG. 10 cleaning equipment 100 such that at least one of cleaning units 42 and 43 is implemented by the FIG. 8 cleaning apparatus 1, the first intermediate medium and the second intermediate medium may have mutually different compositions so that a first difference in sonic velocity between the first cleaning liquid and the first intermediate medium and a second difference in sonic velocity between the second cleaning liquid and the second intermediate medium may be different from each other. In this case, while the cleaning method can be performed with cleaning tank 2 and the like having an internal configuration as conventional, intermediate medium 5 conveyed can be modified in composition (i.e., a liquid introduced as intermediate medium 5 can be modified in composition or to have a modified mixture ratio or the like) to control sonic velocity therein, and cleaning equipment 100 can thus dispense with a heating member or the like. Cleaning equipment 100 thus does not have cleaning tank 2 or the like complicated in configuration.

Example

A study has been done for a desirable angle of refraction of an ultrasonic wave at a bottom of cleaning tank 2, as will be described hereinafter with reference to FIG. 12.

Figure 12:
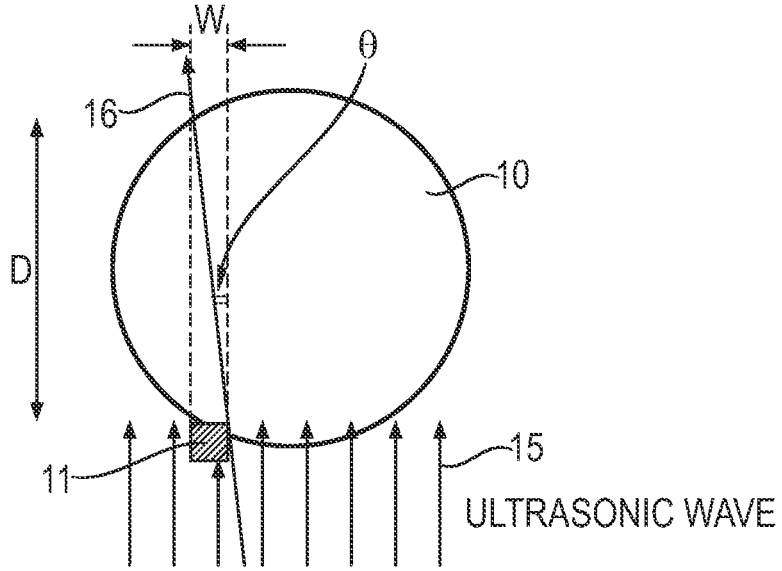
FIG. 12 is a schematic diagram for studying an angle of refraction of an ultrasonic wave in the present invention.

With reference to FIG. 12, herein, substrate 10 of 300 mm in diameter is held by holding member 11 of a width W for the sake of illustration. Holding member 11 shadows a portion having a length D of 250 mm and holding member 11 has width W of 4 mm for the sake of illustration. If an ultrasonic wave traveling along arrow 15 is refracted at an angle θ of 0.9 degree, an area of substrate 10 that is shadowed by holding member 11 and thus not directly exposed to the ultrasonic wave (i.e., shadowed area 12 shown in FIG. 1) can approximately be halved. Accordingly, a targeted value of angle of refraction θ of the ultrasonic wave can be set at one degree for example. Note that if angle of refraction θ is set to have a value larger than one degree, the area shadowed by holding member 11 can further be reduced.

Then, a study has been done for an angle of refraction of an ultrasonic wave in the FIG. 2 cleaning apparatus 1. A result of the study will be described hereinafter with reference to FIG. 13.

Figure 13:
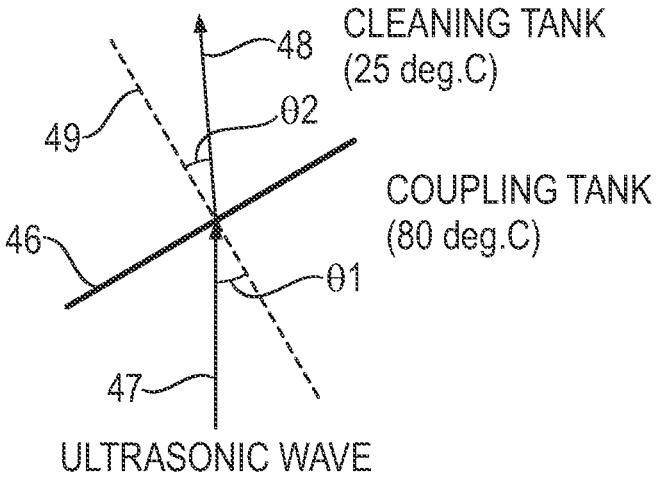
FIG. 13 is a schematic diagram showing an example of calculating an angle of refraction of an ultrasonic wave in the present invention.

As shown in FIG. 13, the FIG. 2 cleaning apparatus 1 has ultrasonic wave generation unit 6 (see FIG. 2) emitting an ultrasonic wave, which in turn travels along an arrow 47, and is incident on the cleaning tank at bottom surface 46 at an angle represented as θ1 and emitted therefrom at an angle represented as θ2 for the sake of illustration. Note that angle of incidence θ1 is an angle formed by a perpendicular 49 to bottom surface 46 of the cleaning tank and arrow 47 (a direction in which an incident ultrasonic wave travels). Furthermore, angle of emittance θ2 is an angle formed by perpendicular 49 to bottom surface 46 of the cleaning tank and an arrow 48 (a direction in which an emitted ultrasonic wave travels). Note that arrow 47 corresponds to the vertical direction, and accordingly, angle of incidence θ1 is identical to the angle of inclination of bottom surface 46 of the cleaning tank relative to the horizontal direction.

Herein, the cleaning tank contains cleaning liquid 4 (see FIG. 2) of pure water having a temperature of 25 degrees centigrade and coupling tank 3 (see FIG. 2) contains intermediate medium 5 (see FIG. 2) of pure water having a temperature of 80 degrees centigrade for the sake of illustration. In this case, cleaning liquid 4 allows sonic velocity of approximately 1,495 m/s therein, and intermediate medium 5 allows sonic velocity of approximately 1,573 m/s therein. Under such conditions, angle of incidence θ1 was varied from 5 to 60 degrees (i.e., the cleaning tank had bottom surface 46 inclined at a varying angle) and angle of emittance θ2 was calculated. The result is shown in Table 1.

TABLE 1

| angle of incidence: θ1 (degrees) | angle of emittance: θ2 (degrees) | angular variation (degrees) |
|---|---|---|
| 5 | 4.8 | −0.2 |
| 10 | 9.5 | −0.5 |
| 15 | 14.3 | −0.7 |
| 20 | 19.0 | −1.0 |
| 25 | 23.7 | −1.3 |
| 30 | 28.4 | −1.6 |
| 35 | 33.1 | −1.9 |
| 40 | 37.7 | −2.3 |
| 45 | 42.3 | −2.7 |
| 50 | 46.9 | −3.1 |
| 55 | 51.3 | −3.7 |
| 60 | 55.6 | −4.4 |

Table 1 shows angle of incidence θ1 (angle of incidence on the bottom surface of the cleaning tank, which is identical to the inclination of the bottom surface of the cleaning tank if the ultrasonic waves travel in vertical direction), angle of emittance θ2, and an angular variation. Note that the angular variation is calculated as an angle of emittance minus an angle of incidence. As can be seen from Table 1, the angular variation (or angle of refraction θ of FIG. 12) is one degree or larger for angle of incidence θ1 of 20 degrees or larger. Accordingly, when cleaning liquid 4 and intermediate medium 5 conditioned as above are used, angle of incidence θ1 (i.e., cleaning tank 2 having a bottom surface inclined at an angle) of 20 degrees or larger allows an ultrasonic wave to be refracted at a sufficiently large angle.

Then, a study has been done for an angle of refraction of an ultrasonic wave in the FIG. 8 cleaning apparatus 1. A result of the study will be described with reference to FIG. 14.

Figure 14:
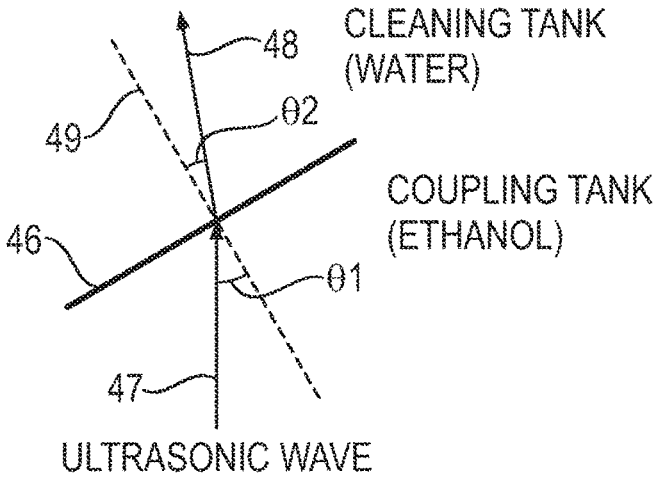
FIG. 14 is a schematic diagram showing another example of calculating an angle of refraction of an ultrasonic wave in the present invention.

As shown in FIG. 14, the FIG. 8 cleaning apparatus 1, as well as the FIG. 2 cleaning apparatus 1, has ultrasonic wave generation unit 6 (see FIG. 8) emitting an ultrasonic wave, which in turn travels along arrow 47, and is incident on the cleaning tank at bottom surface 46 at an angle represented as θ1 and emitted therefrom at an angle represented as θ2 for the sake of illustration. Angle of incidence θ1, angle of emittance θ2, and the like are defined as have been done with reference to FIG. 13.

Herein, the cleaning tank contains cleaning liquid 4 (see FIG. 8) of pure water having a temperature of 25 degrees centigrade and coupling tank 3 (see FIG. 8) contains intermediate medium 5 (see FIG. 8) of ethanol having a temperature of 25 degrees centigrade for the sake of illustration. In this case, cleaning liquid 4 allows sonic velocity of approximately 1,495 m/s therein, and intermediate medium 5 allows sonic velocity of approximately 1,144 m/s therein. Under such conditions, angle of incidence θ1 was varied from 5 to 45 degrees (i.e., the cleaning tank had bottom surface 46 inclined at a varying angle) and angle of emittance θ2 was calculated. The result is shown in Table 2.

TABLE 2

| angle of incidence: θ1 (degrees) | angle of emittance: θ2 (degrees) | angular variation (degrees) |
|---|---|---|
| 5 | 6.5 | 1.5 |
| 10 | 13.1 | 3.1 |
| 15 | 19.8 | 4.8 |
| 20 | 26.6 | 6.6 |
| 25 | 33.5 | 8.5 |
| 30 | 40.8 | 10.8 |
| 35 | 48.6 | 13.6 |
| 40 | 57.2 | 17.2 |
| 45 | 67.5 | 22.5 |

Table 2, as well as table 1, shows angle of incidence θ1, angle of emittance 82, and an angular variation. Note that the angular variation is calculated as an angle of emittance minus an angle of incidence, similarly as indicated in table 1. As can be seen from table 2, the angular variation (or angle of refraction θ of FIG. 12) is 1.5 degree or larger for angle of incidence θ1 of 5 degrees or larger. Furthermore, if the angle of incidence θ1 is 30 degrees or larger, the angular variation is 10 degrees or larger. Accordingly, when cleaning liquid 4 and intermediate medium 5 conditioned as above are used, angle of incidence θ1 (i.e., cleaning tank 2 having a bottom surface inclined at an angle) of 5 degrees or larger allows an ultrasonic wave to be refracted at a sufficiently large angle.

It should be understood that the embodiments and examples disclosed herein are illustrative and non-restrictive in any respect. The scope of the present invention is defined by the terms of the claims, rather than the description above, and is intended to include any modifications within the scope and meaning equivalent to the terms of the claims.

The present invention is advantageously applicable to ultrasonic cleaning apparatuses and methods, in particular.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

REFERENCE SIGNS LIST

1: cleaning apparatus
2: cleaning tank
3: coupling tank
4: cleaning liquid
5: intermediate medium
6: ultrasonic wave generation unit
7: modification unit
10: substrate
11: holding member
12: area
13, 15, 16, 20, 32, 33, 47, 48: arrow
17: heater
18, 19: pipe
21: control unit
27, 28: automatic valve
41-43: cleaning unit
46: bottom surface
49: perpendicular
100: cleaning equipment

The invention claimed is:

1. A cleaning method for cleaning an object, the method comprising:

ultrasonically vibrating the object, in a cleaning tank including a cleaning liquid, via an intermediate medium disposed in a coupling tank and in contact with the cleaning tank, a bottom surface of the cleaning tank being inclined relative to a bottom surface of the coupling tank, wherein the cleaning tank is disposed in the coupling tank, the ultrasonically vibrating including (a) a first ultrasonic vibrating of the cleaning liquid with a first difference between respective sonic velocities allowable in the cleaning liquid and the intermediate medium, and (b) a second ultrasonic vibrating of the cleaning liquid with a second difference between respective sonic velocities allowable in the cleaning liquid and the intermediate medium; and adjusting an intermediate medium temperature so as to set the first difference and the second difference differently from each other such that ultrasonic waves, generated by the ultrasonically vibrating and traveling in a first direction at a boundary portion between the cleaning liquid held in the cleaning tank and the intermediate medium in contact with the bottom surface of the cleaning tank, are refracted in a second direction that is different than the first direction.

2. The method of claim 1, wherein the adjusting the intermediate medium temperature includes:

using a heating member.

3. The method of claim 1, wherein the adjusting includes:

modifying a retention time of the intermediate medium being in contact with the cleaning tank.

4. The method of claim 1, wherein the intermediate medium comprises degassed water, and wherein the adjusting includes modifying a retention time of the intermediate medium being in contact with the cleaning tank.

5. The method of claim 1, wherein the intermediate medium comprises degassed water.

* * * * *